US005626400A

United States Patent [19]

Humphries

[11] Patent Number: 5,626,400

[45] Date of Patent: May 6, 1997

[54] TOOTHBRUSHES

[76] Inventor: Victor A. Humphries, 83 River Road, Emu Plains, New South Wales, 2750, Australia

[21] Appl. No.: 142,295

[22] PCT Filed: May 22, 1992

[86] PCT No.: PCT/AU92/00231

§ 371 Date: Nov. 16, 1993

§ 102(e) Date: Nov. 16, 1993

[87] PCT Pub. No.: WO92/20256

PCT Pub. Date: Nov. 26, 1992

[30] Foreign Application Priority Data

May 22, 1991 [AU] Australia ..... PK6253

[51] Int. Cl.[6] ..... A46D 3/00

[52] U.S. Cl. ..... 300/21; 300/20

[58] Field of Search ..... 300/10, 11, 20, 300/21; 15/184

[56] References Cited

U.S. PATENT DOCUMENTS 1,796,001 3/1931 Church ..... 15/167.1

2,254,365 9/1941 Griffith et al. ..... 15/172

3,280,417 10/1966 Wexler ..... 15/184

3,325,847 6/1967 Meranto ..... 15/184

4,829,621 5/1989 Phenegar ..... 15/172

5,048,144 9/1991 Andrews ..... 15/184

*Primary Examiner*—John M. Husar

*Attorney, Agent, or Firm*—Abelman, Frayne & Schwab

[57] ABSTRACT

A toothbrush head deforming device (10) is provided for a deformable toothbrush (16). The deformable toothbrush (16) for which the device can be used has at least one region (20, 21) of its head (15) weakened so that a sharp and discrete deformation or bending about the weakened region (20, 21) may occur. The deforming device (10) includes means (18, 19) for obstructing the movement of a desired part of the head (15) adjacent a weakened region (20, 21) so that upon application of pressure on the part of the head (15) that does not have its movement obstructed, a sharp and discrete deformation or bending about the weakened region (20, 21) may occur.

1 Claim, 3 Drawing Sheets

TOOTHBRUSHES

FIELD OF INVENTION

The present invention relates to toothbrushes and more particularly to both means for deforming or bending deformable toothbrushes and a toothbrush with bristles that may be cut into a desired configuration or contour.

BACKGROUND ART

A deformable toothbrush is described in International Patent Application No. PCT/AU91/00257 incorporated herein by reference. The deformable toothbrush described in that specification comprises an elongated handle part, a head part and a neck part joining the handle part and head part. The head part has bristles projecting from at least one side thereof and at least one region of the head part is weakened to allow deformation in the head part to suit the shape of the user's dental arches.

To date, deformation of the weakened region(s) of the toothbrush described in International Patent Application No. PCT/AU91/00257 has been done by differential hand or finger pressure applied by the user on both sides of the weakened region(s).

Conventionally, the bristles of most new toothbrushes have all been at a single height so as to offer a level upper bristle surface or brushing platform to all the teeth of all users.

Obviously, a toothbrush having a uniform bristle height may not suit all users since it will not take into account the peculiar size and shape of the user's teeth and dental arches.

More recently, some toothbrushes have been designed with a contoured brushing platform, primarily by having a series of shorter bristles in the middle of the brushing platform. The depression so produced in the middle of the brushing platform is intended to provide a more snug brushing action against the teeth.

However, these contoured bristle toothbrushes have the contour of their brushing platform predetermined before purchase and so will only suit :some users whose tooth shape and dental arches conform to the predetermined contour.

DISCLOSURE OF INVENTION

According to one aspect of the invention there is provided a device for deforming the head of a deformable toothbrush, the deformable toothbrush having at least one region of its head weakened so that a sharp and discrete deformation or bending about the weakened region may occur, the toothbrush head deforming device including means for obstructing the movement of a desired part of the head adjacent a weakened region so that upon application of pressure on the part of the head that does not have its movement obstructed, a sharp and discrete deformation or bending about the weakened region may occur.

In a preferred form of the invention, the device further includes a housing to snugly receive a section of the toothbrush head, the housing including the obstructing means.

Preferably, the section of the toothbrush is slideably received within the housing.

Preferably, the obstructing means is formed integrally with the housing.

It is also preferred that the obstructing means overlaps at least a portion of the surface of the head from which the bristles protrude.

Preferably, the toothbrush head deforming device is a constituent part of packaging for a deformable toothbrush.

According to another aspect of the invention there is provided a toothbrush comprising an elongated handle part and a head part having bristles projecting from at least one side thereof, and including means adapted for cutting or adjusting the bristle height.

In a preferred form of the invention, the bristles include identification markings for identifying one or more desirable cutting locations.

The identification markings may comprise a single coloured spot located along the length of each bristle that, when the bristles are viewed in their assembled form on the toothbrush, identify an imaginary line or plane joining each spot of all the bristles and along which the user or the user's dentist should cut to produce the desired contour or configuration of brushing platform.

Preferably, each single spot that makes up the imaginary line or plane that, when cut, produces the desired contour of brushing platform is of a uniform colour.

In this way, additional desirable contours may be available for the one toothbrush by application of different coloured spots along each bristle. Preferably, the bristles are cut at the desired spots by a sharp knife or scissors.

The head and/or handle parts of this toothbrush may be deformable at predetermined locations in the manner described in International Patent Application No. PCT/AU91/00287, incorporated herein by reference.

BRIEF DESCRIPTION OF THE DRAWINGS

In order that these inventions may be more readily understood and put into practical effect, reference will be made to the accompanying drawings, in which.

DESCRIPTION OF PREFERRED EMBODIMENTS

Figure 1:
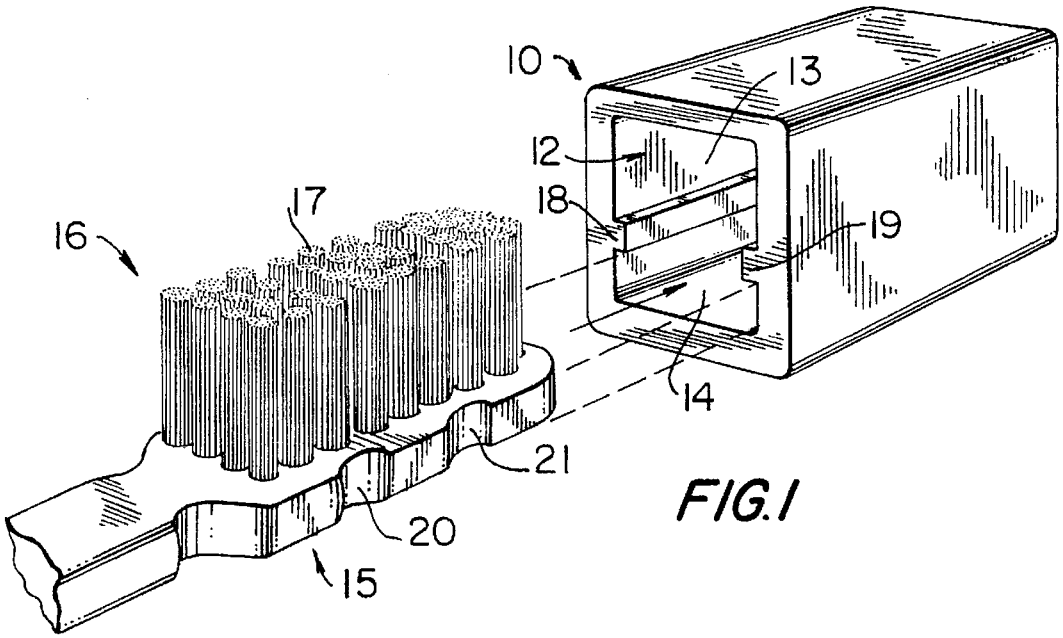
FIG. 1 is a perspective view of a device for deforming a deformable toothbrush according to a first embodiment of the first invention, with a deformable toothbrush shown aligned therewith.
Figure 2:
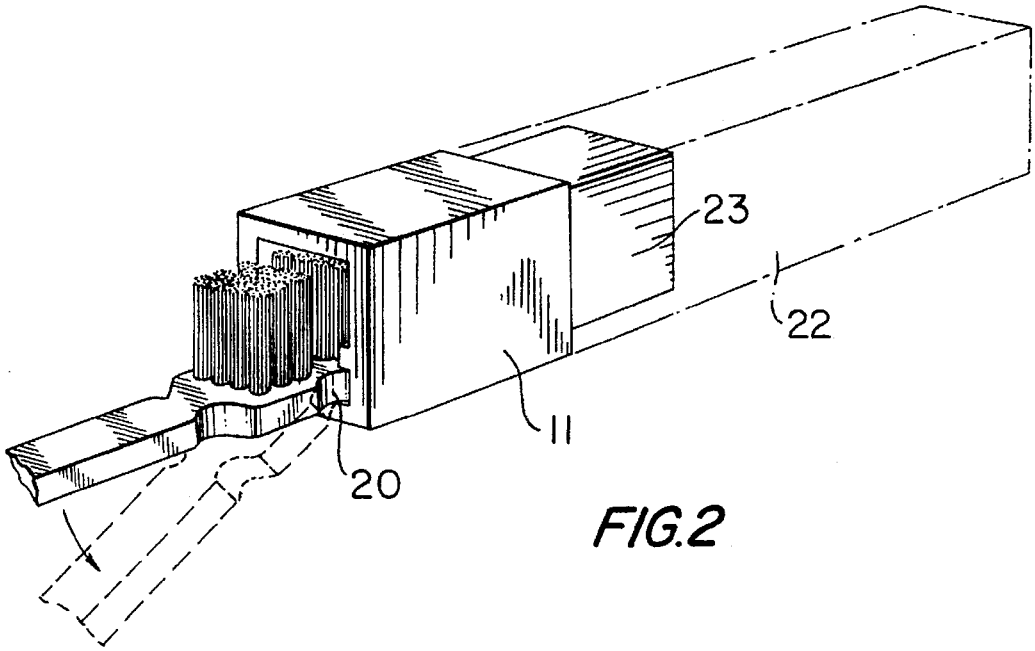
FIG. 2 is a perspective view of the toothbrush deforming device of FIG. 1 housing a deformable toothbrush that has been bent or deformed about a weakened region, with the toothbrush deforming device formed as a constituent part of packaging for the deformable toothbrush.

The toothbrush deforming device 10 of FIGS. 1 and 2 comprises a hollow housing 11, substantially rectangular in cross-section and having an opening 12. The device is preferably made of a resilient but light plastic material. The opening 12 has two parts, an upper part 13 and a lower part 14 divided by inwardly directed lips 18 and 19. The lower part 14 of the opening 12 is adapted to slideably and snugly receive the head part 15 of the toothbrush 16.

The upper part 13 of the opening 12 is adapted to receive the bristles 17 upstanding from the head part 15 of the toothbrush 16.

The snug fit of the head part 15 in the lower part 14 of the opening 12 is provided by the lips 18 and 19 that project in opposite directions partly across the opening 12, the lower part 14 defining a groove. When the head part 15 is received therewithin, the lips 18 and 19 abut against the peripheral surfaces of the upper surface of the head part 15 as shown in FIG. 2.

The head part 15 has two weakened regions 20 and 21, which, in this instance, comprise localized narrowings in the cross-section of the head part 15.

In use, the head part 15 of the toothbrush 16 is slid through the opening lower part 14 only as far as one of the weakened regions 20 or 21.

In FIG. 2, the head part 15 is shown penetrating into the device 10 as far as weakened region 20 to assume a snug fit.

The bristles 11 forward of the weakened region 20 remain standing within the upper part 13 of the opening 12.

In this position, the lips 18 and 19 and walls of the lower opening part 14 provide an obstruction to the vertical movement of the portion of the head part 15 that is snugly received in the device 10.

With the device 10 held stationary, the portion of the toothbrush 16 not penetrating into the device 10 can have pressure applied thereto in a vertical direction immediately adjacent to the weakened region 20 so as to urge that portion to be sharply and discretely deformed or bent about the weakened region 20 as desired.

The location of the head part 15 having been bent around weakened portion 20 is shown in dotted outline in FIG. 2.

In this way, a second desired deformation may occur at weakened region 21 by retracting the head part 15 from the device as far as weakened region 21, and, whilst holding the device 10 stationary, applying vertical pressure immediately adjacent to the weakened region 21. A doubly deformed or bent toothbrush head part 15 will then result which may suit the size and shape of the user's dental arches.

The device 10 of FIG. 2 is shown as a constituent part of packaging 22 for the deformable toothbrush 16.

Formed integrally with the device 10 is an extension member 23 that is adapted to fit tightly into the inner walls at one end of the packaging 22.

This is advantageous in that the device 10 may be packaged and sold with the deformable toothbrush 16 and the user's grip of the device may be improved during manipulation of the toothbrush around a weakened region.

Figure 3:
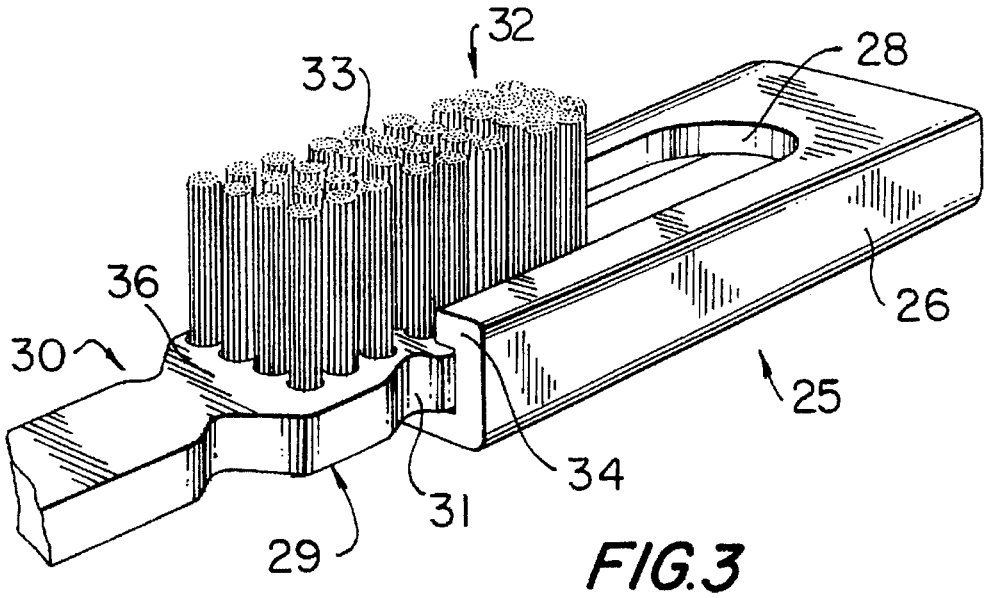
FIG. 3 is a perspective view of a toothbrush deforming device according to a second embodiment of that invention housing a deformable toothbrush that has been bent or deformed about a weakened region.

The toothbrush shaft deforming device 25 shown in FIG. 3 comprises a hollow elongated member 26, substantially rectangular in cross-section, having an opening and a longitudinal slot 28 continuous with a portion of the opening. The head part 29 of the toothbrush 30 has a weakened region comprising a localised narrowing 31 in the cross-section of the head part 29.

In use, the head part 29 of the toothbrush 30 may be slid through the opening only as far as the narrowing 31 with the portion 32 of the head part 29 forward of the narrowing 31 fitting snugly into the member 26 as shown in FIG. 3. When so fitted, the bristles 33 in the portion 32 project through the slot 28 and the continuous lip 34 bordering the slot 28 abuts against the peripheral surface of the upper face 36 of the head part 29 and stops the portion 32 from moving upwardly through the slot 28.

With the toothbrush 30 Gripped in this position, the portion of the toothbrush 30 rearward of the narrowing 31 can be vertically urged about the narrowing 31 so as to produce a desirably deformed toothbrush.

The toothbrushes 16 and 30 may also have a weakened neck region (not shown) so that when the toothbrush is inserted into either of the devices 10 or 25 as far as the weakened neck region, the non-penetrating toothbrush shaft may be deformed about the neck by appropriate manipulation of the handle part.

Such further deformation at the neck region may enhance the effectiveness of the deformed toothbrush to suit the size and shape of the user's dental arches.

Figure 4:
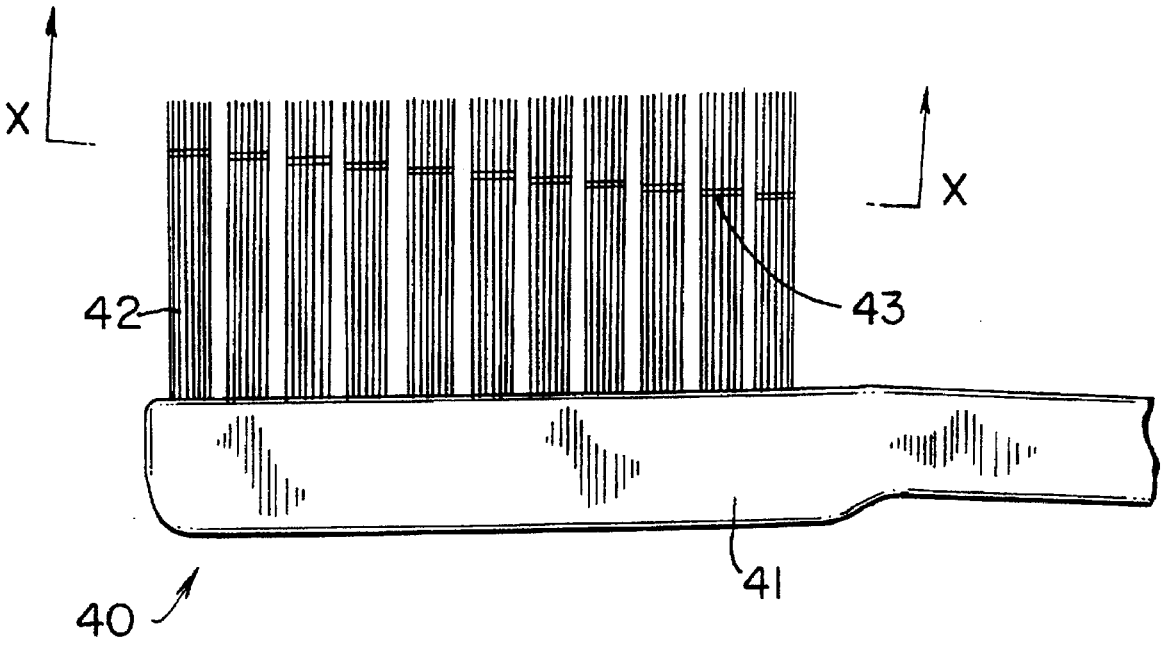
FIG. 4 is a side view of the head portion of a toothbrush according to a first embodiment of the second invention, having bristles that include identification markings for identifying a preferred bristle cutting location.

A bristle height adjustable toothbrush is shown in FIG. 4 which has a head portion 40 that includes a head part 41 and bristles 42 all of uniform height attached thereto.

Each bristle 42 has a coloured spot 43 at a location corresponding to the desired cutting plane X—X. Each spot 43 is coloured by an inert dye. Cutting the bristles 42 along plane X—X will produce a brushing platform that is contoured downwardly from the front bristles to the rear bristles. Such a contoured surface may provide a sharp brushing profile to the teeth and so be effective in removing food particles lodged between teeth and for scouring deposits from tooth surfaces.

Figure 5:
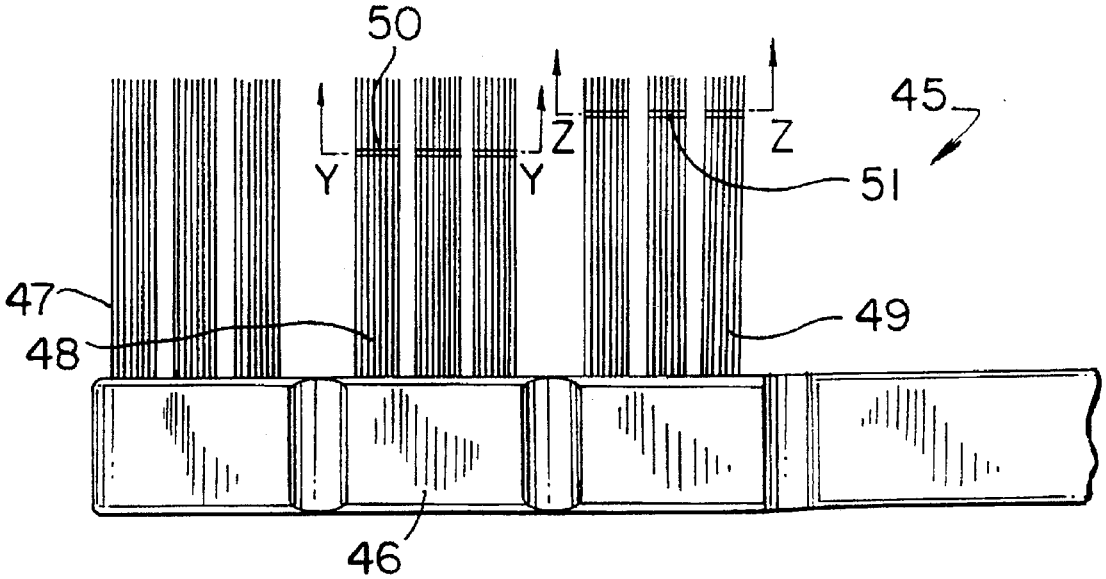
FIG. 5 is a side view of the head portion of a toothbrush according to a second embodiment of the second invention, having bristles that include identification markings for identifying a preferred bristle cutting location, and, FIG. 6 is a side view of the head portion of the toothbrush of FIG. 5 having had its bristles cut along the marked cutting location.

The head portion 45 of the bristle height adjustable toothbrush (shown in part in FIG. 5) has a deformable head part 46 and the bristles are divided into three sections, a forward section 47, middle section 48 and rearward section 49.

The bristles in the middle section 48 and rearward section 49 have coloured spots 50 and 51 that correspond to desired cutting planes Y—Y and Z—Z respectively.

Figure 6:
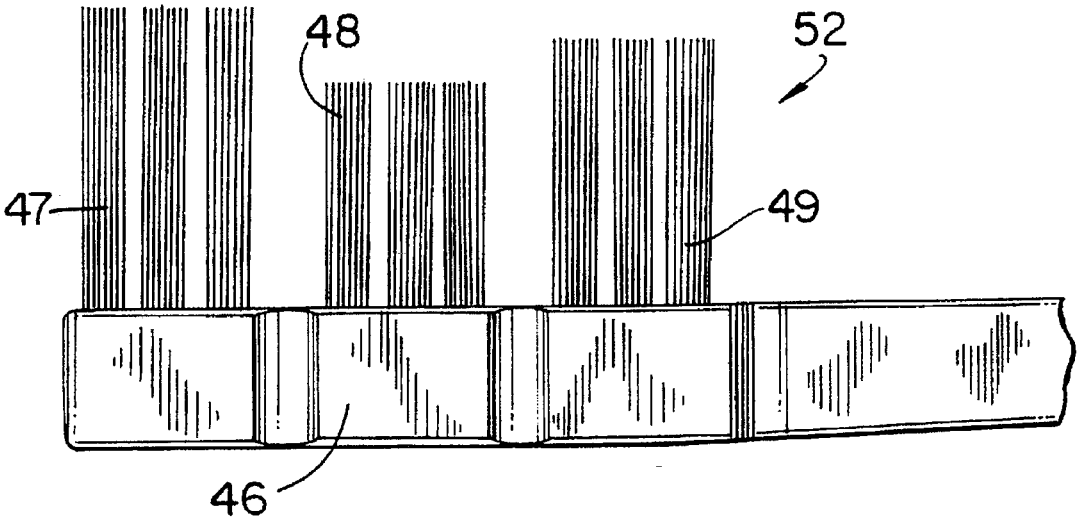

Cutting the bristles along planes Y—Y and Z—Z will produce a brushing platform 52 that is contoured as shown in FIG. 6.

When brushing teeth with a toothbrush having the brushing platform 52 of the kind shown in FIG. 6, the taller forward section bristles 47 provide a small and flat surface area brushing profile to the teeth and this is advantageous for the individual brushing of small teeth, such as those of infants or small children.

Also, the depression at the middle of the brushing platform 52, formed by cutting bristle section 48 along marked cutting plane Y—Y, may be useful for brushing around corners of teeth.

Furthermore, the toothbrush head part having the brushing platform 52 may be deformed about the weakened regions to provide another contour of brushing platform to suit the size and shape of the user's teeth and dental arches.

Various modifications may be made to details of design and construction without departing from the scope or ambit of the invention.

I claim:

1. A method for deforming the head of a deformable toothbrush the said deformable toothbrush having at least one region of a head thereof weakened so that a sharp and discrete deformation or bending about the weakened region may occur, said head including bristles projecting from an upper surface thereof, the upper surface of said head including peripheral surfaces on opposite sides of said bristles, said method comprising:

(i) providing a toothbrush head deforming device comprising a housing that includes an opening that allows access of said head within the housing and means for obstructing the movement of a desired part of the head adjacent a weakened region, said obstructing means comprising a groove for slidably engaging said head within said housing, and a pair of lips defining an upper opening of said groove for protrusion of the bristles;

(ii) engaging said toothbrush in said groove so that the lips abut against said peripheral surfaces of the upper surface of the head so as to provide a snug fit of said head within said groove and lips;

(iii) applying pressure on the part of the head that does not have its movement obstructed so that a sharp and discrete deformation or a bending of said head about said weakened region may occur.

* * * * *